US011282342B2

(12) United States Patent
Koustas et al.

(10) Patent No.: US 11,282,342 B2
(45) Date of Patent: Mar. 22, 2022

(54) PARAMUTUAL WAGERING APPLIED TO FANTASY SPORTS

(71) Applicant: AG 18, LLC, Denver, CO (US)

(72) Inventors: Nicholas Koustas, Cherry Hills, CO (US); John Mix, Denver, CO (US); Xander Oxman, Denver, CO (US)

(73) Assignee: AG 18, LLC, Denver, CO (US)

( * ) Notice: Subject to any disclaimer, the term of this patent is extended or adjusted under 35 U.S.C. 154(b) by 0 days.

(21) Appl. No.: 16/542,997

(22) Filed: Aug. 16, 2019

(65) Prior Publication Data

US 2019/0371128 A1 Dec. 5, 2019

Related U.S. Application Data

(63) Continuation of application No. 16/410,819, filed on May 13, 2019, which is a continuation of application No. 12/176,948, filed on Jul. 21, 2008, now Pat. No. 10,290,185.

(60) Provisional application No. 60/950,765, filed on Jul. 19, 2007.

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/32* (2013.01)

(58) Field of Classification Search
CPC ..... A63F 2011/0097; G06F 17/608; G06F 17/32; G06Q 50/34
See application file for complete search history.

(56) References Cited

U.S. PATENT DOCUMENTS

| | | | |
|---|---|---|---|
| 5,957,775 | A | 9/1999 | Cherry |
| 6,347,086 | B1 | 2/2002 | Strachan |
| 7,896,740 | B2 | 3/2011 | Asher et al. |
| 9,557,901 | B2 | 1/2017 | Hughes et al. |
| 9,569,922 | B1 | 2/2017 | Johnson et al. |
| 2006/0246990 | A1 | 11/2006 | Downes |
| 2006/0258432 | A1 | 11/2006 | Packer et al. |
| 2006/0287094 | A1 | 12/2006 | Mahaffey et al. |
| 2007/0060380 | A1 | 3/2007 | McMonigle et al. |

*Primary Examiner* — William H McCulloch, Jr.
*Assistant Examiner* — Ankit B Doshi

(57) ABSTRACT

The present invention can provide a system and method for paramutual-style fantasy sports wagering and entertainment. In one exemplary embodiment, the present invention can include a method for paramutual fantasy betting, the method comprising providing a bettor with a first plurality of players of a first player type, providing a bettor with a second plurality of players of a second player type, receiving a proposition from the bettor, wherein the proposition comprises a first player from the first plurality of players and a second player from the second plurality of players, receiving a wager amount from the bettor, receiving a paramutual bet for the proposition, calculating paramutual odds for the proposition, and determining a result for the bettor, wherein the result is based on the paramutual bet and the proposition.

30 Claims, 10 Drawing Sheets

PARAMUTUAL WAGERING APPLIED TO FANTASY SPORTS

CROSS-REFERENCE TO RELATED APPLICATION

This application is a continuation of U.S. patent application Ser. No. 16/410,819, filed on May 13, 2019; which is a continuation of U.S. patent application Ser. No. 12/176,948, filed on Jul. 21, 2008, and issued as U.S. Pat. No. 10,290,185; which claims priority to U.S. Provisional Application No. 60/950,765, filed Jul. 19, 2007, all of which are incorporated herein by reference in their entirety for all purposes.

FIELD

The present invention relates generally to systems and methods for sports wagering and entertainment and more particularly to systems and methods for paramutual wagering for fantasy sports.

BACKGROUND

In fantasy sports, fantasy owners generally build and manage a team that competes over an entire season against teams built by other fantasy owners. Fantasy owners typically build or draft a roster of players at the beginning of each season from which they will select a lineup for each game of the season. In current systems and methods, fantasy owners earn points based on the game-by-game statistical performances of their selected players and those point totals are directly compared to the point totals of other fantasy owners. In such systems, fantasy owners need to both pick a quality roster and manage that roster well during the season.

In other fantasy sports systems, fantasy owners are given a certain point or salary allotment which they use on a game-by-game or week-by-week basis to select players. Once again, the fantasy owners compete with other fantasy owners to see who can accumulate the highest number of points. As well, fantasy sports systems apply to many different sports and activities. For example, fantasy sports systems are applied to football, baseball, hockey, golf, and auto racing, just to name a few.

With these systems, fantasy owners are limited to competing only against other fantasy owners who wish to participate for the same time duration. Since there is no way to standardize the results, fantasy owners cannot easily join the competition late, compete intermittently, or leave early and still be able to reasonably participate.

Moreover, current fantasy sports bettors are generally limited to competing against an undefined opponent. Rather than measuring success by how well their selected team performed, fantasy sports bettors are always betting against how other fantasy sports bettors performed. To this extent, the opponent is undefined until after all fantasy sport bettor have selected a lineup. What's more, fantasy sports bettors are generally limited to either fixed odds betting or betting pools. Fantasy sports bettors always select their lineup and receive a payout only if that lineup wins. A fantasy sports system may payout lesser, graduated amounts for lineups placing in subsequently lower places. This limits fantasy sports bettors to a restricted number of wagering options and strategies. Since there is no standardized measure of success, fantasy sports bettors are limited to trying to select the players who will achieve the greatest number of points.

Finally, organizations that provide fantasy sports services must charge either flat rates for specific services or charge a flat rate for bettors to participate. This limits fantasy sports organizations to restricted revenues especially considering the restricted wagering options that bettors face.

Accordingly, there is a need for a system and method for allowing fantasy sports bettors greater bet variety and greater participation flexibility along with allowing fantasy sports services greater revenue potential.

SUMMARY

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present invention can provide a system and method for paramutual-style fantasy sports wagering and entertainment. In one exemplary embodiment, the present invention can include a method for paramutual fantasy betting, the method comprising providing a bettor with a first plurality of players of a first player type, providing a bettor with a second plurality of players of a second player type, receiving a proposition from the bettor, wherein the proposition comprises a first player from the first plurality of players and a second player from the second plurality of players, receiving a wager amount from the bettor, receiving a paramutual bet for the proposition, calculating paramutual odds for the proposition, and determining a result for the bettor, wherein the result is based on the paramutual bet and the proposition. In further embodiments, the wager can be a monetary or non-monetary wager. In another further embodiment, the method can include determining the payout for the bettor, wherein the payout is based on the result, the wager amount, the final paramutual odds for the first proposition, and a commission amount to a betting house.

In another embodiment, the present invention can include a method for paramutual fantasy betting, the method comprising receiving a wager amount from a bettor of a plurality of bettors, receiving a paramutual bet from the bettor, receiving a first proposition from the bettor, wherein the first proposition comprises an at least one first player, calculating paramutual odds for the first proposition, and determining a result for the bettor, wherein the result is based on the paramutual bet and the first proposition. Further embodiments can include receiving a second proposition from the bettor, wherein the second proposition comprises an at least one second player, and receiving an exacta bet from the bettor for the first proposition and the second proposition.

A computer-usable medium having computer readable instructions stored thereon for execution by a processor to perform a method comprising, receiving a wager amount from a bettor of a plurality of bettors, receiving a paramutual bet from the bettor, receiving a first proposition from the bettor, wherein the first proposition comprises an at least one first player, calculating paramutual odds for the first proposition, and determining a result for the bettor, wherein the result is based on the paramutual bet and the first proposition. In further embodiment, the paramutual bet is a win bet, a place bet, or a show bet.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

Figure 1:
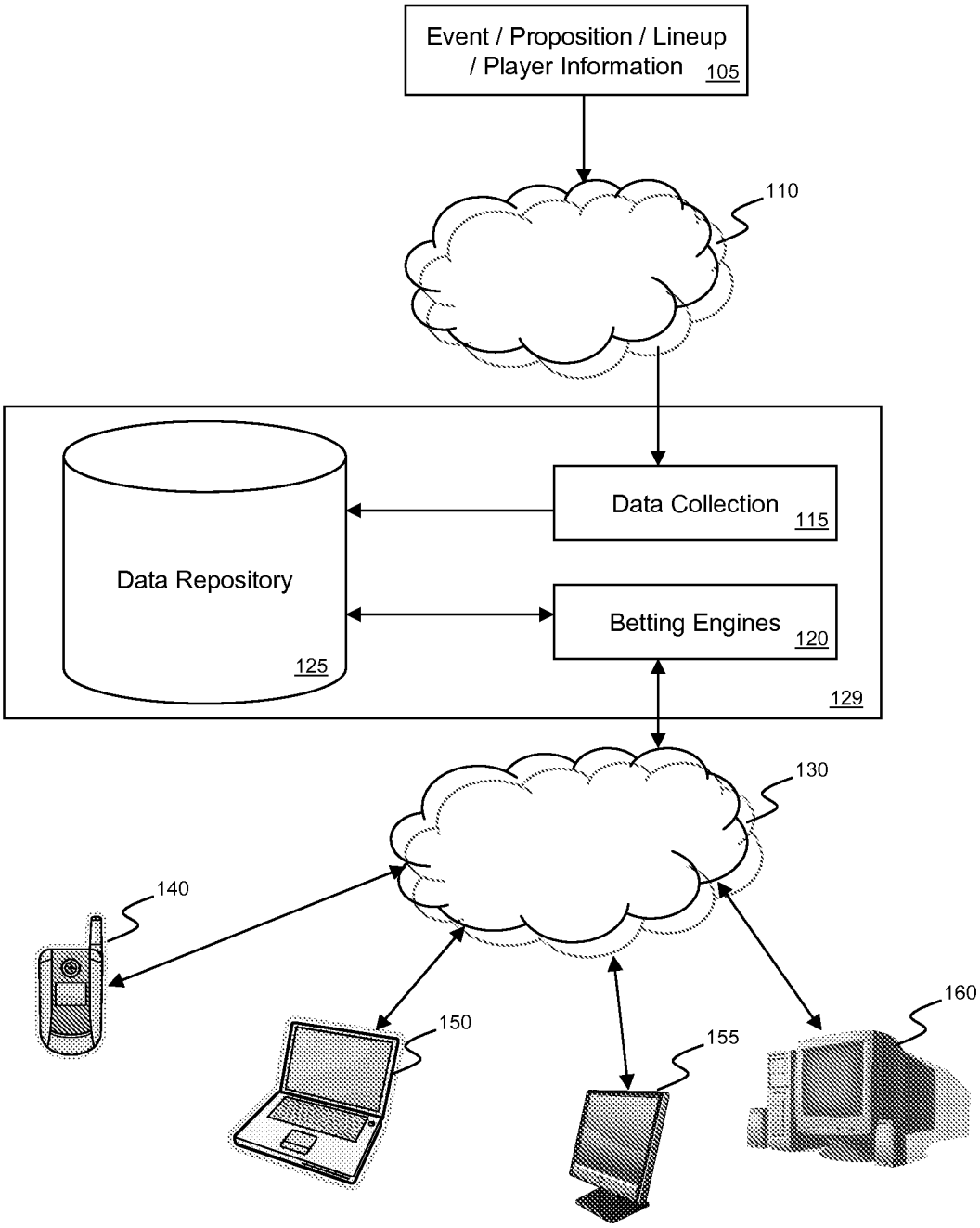
FIG. 1 illustrates a typical architecture on which embodiments of the present invention could be utilized.

Referring now to the drawings, where like or similar elements are generally designated with identical reference numerals throughout the several views, and referring in particular to FIG. 1, it illustrates an exemplary architecture on which embodiments of the present invention could be utilized. This embodiment includes a server 129 connected to bettors through a network 130. The server generally contains software for collecting, generating and displaying information for use by bettors; for collecting information from bettors; and for analyzing that information. By way of example, a bettor or bettors could be connected to the server through a network device such as a personal computer 150, an interactive television 155, a kiosk 160, or a wireless device 140, such as a PDA or cell phone. It is to be understood that the a bettor is not limited to the use of such devices, but could directly interface with the server or use some other, unmentioned interface device. It is also understood that the use of the term bettor represents any person who has placed, or who may place, a wager. The use of the term bettor is not limited only to those people who have bet, or who are betting, and should be understood to include any person who has bet, who is betting, or who may bet. The illustrated arrangement of these components is logical and not meant to be an actual hardware diagram. The network that connects the bettors to the server 129 could be the internet, an intranet, a corporate LAN, or any other type of network. Thus, the components can be combined, hardwired or further separated in an actual implementation. Moreover, the construction of each individual component is well-known to those of skill in the art.

FIG. 1 also includes a source 105 for event, proposition, lineup, and player information. The information source 105 could be connected to the server through a network or direct input. The network 110 connecting the server and the information source could also be the internet, an intranet, a corporate LAN, or any other type of network. Thus, the components can be combined, hardwired, or further separated in an actual implementation. Moreover, the construction of each individual component is well-known to those of skill in the art.

Referring to the server 129 in FIG. 1, it illustrates an exemplary architecture including a data repository 125. It is to be understood that in other embodiments, the server 129 might not persistently store data, but instead might only processes bettor, event, proposition, and player information as well as event and player results for immediate or imminent communication to or from the bettor. Also, those of skill in the art understand variations in the architecture allowing for the data repository 125 to be maintained outside the server 129.

Figure 2:
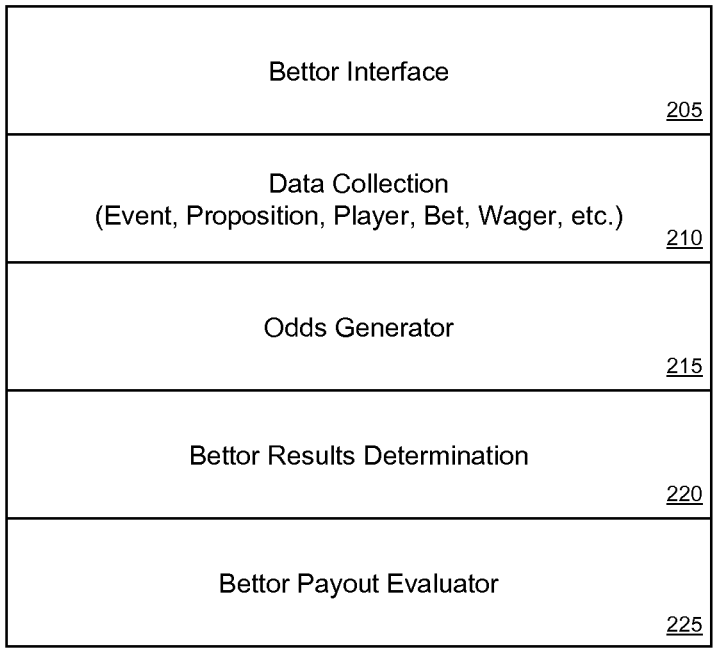
FIG. 2 illustrates exemplary software modules that could be operated by the server.

Referring now to FIG. 2 it illustrates exemplary software modules that could be the server 129. These modules are described according to their functions and could be grouped differently. As those of skill in the art understand, many of these functions could be combined together into one software module and similarly, many of these functions could be divided into several different software modules. These functional modules are described briefly with regard to FIG. 2 and in more detail with regard to the subsequent flow charts.

Referring first to the bettor interface module 205, it is an input-output controller and serves as the interface for the bettor or the bettor's computing devices to interact with the other modules. Similarly, the bettor interface module 205 directs the communications from the other modules to the bettor. For example, the bettor interface module 205 could be used to present paramutual-style lineup odds from the odds generator module 215 to the bettor.

The second software module shown in FIG. 2 is a data collection module 210. This module is designed to collect and provide information such as event, proposition, bet, wager, and player data to and from both the bettor and other external and internal sources. For example, the data collection module 210 could be designed to communicate with the odds generator module 215 so that after player data and bet type have been collected, the odds generator module 215 could calculate a given lineup's paramutual-style odds. The data collection module 210 could read and write the information to long-term and short-term storage.

The third software module shown in FIG. 2 is an odds generator module 215. Paramutual-style odds at least partially derived from the betting patterns of bettors are calculated here and are used to help determine the bettors' payouts, if any. In paramutual-style fantasy betting, paramutual-style odds are determined much as they are in traditional paramutual betting. However, because fantasy sports often involves lineups in which players are combined and then their fantasy points aggregated, rather than involving a single contestant in one race, the identical method of calculating paramutual-style odds may differ at least slightly in some paramutual-style fantasy betting. In one exemplary embodiment, the paramutual-style odds for a single player are based at least in part on the betting activity on that player. When single players are included in a lineup, the paramutual-style odds for the lineup could be an average of the paramutual-style odds of all the single players. The paramutual-style lineup odds could also be weighted according to the betting activity on certain players within the lineup. Those of skill in the art can imagine the variations in determining paramutual-style odds for lineups. The term "paramutual-style fantasy betting" does not entail limiting paramutual-style odds or payouts to strictly traditional paramutual betting methods. Instead, "paramutual-style fantasy betting" encompasses enhancements to traditional paramutual betting methods to accommodate the unique characteristics of fantasy sports scoring. The odds generator module 215 could communicate with the data collection module 210 to receive information about players to help determine the paramutual-style odds. It could also communicate with the bettor interface module 205 to present the paramutual-style odds to the bettor.

The odds generator module 215 could be configured to determine paramutual-style odds after betting is closed or periodically while betting takes place. Further, the odds generator module 215 could be configured to determine paramutual-style odds upon certain occurrences, such as when a bettor requests odds or after a bettor places a wager. Those of skill in the art can understand the different intervals in which paramutual-style odds can be generated.

"Paramutual-style odds" or "paramutual odds" refer generally to basing payout amounts to bettors on the bettors' wagers and to not fixing the payout amounts until the betting is closed. The payout amount to a bettor for a fantasy player selection generally goes up if less money is wagered on that player selection. Likewise, the payout amount to a bettor for a fantasy player selection generally goes down if more money is wagered on that player selection. Paramutual-style odds also remain in flux until the betting is closed at some time before the start of the event or when the fantasy players actual competition begins. In other words, the actual payouts that bettors may receive are not finalized until all bets for the players have been collected.

Returning back to FIG. 2, the bettor results determination module 220 could communicate with other internal modules in order to determine bettor results. For example, the bettor score determination module could communicate with the data collection module 210 in order to acquire external, non-bettor supplied, information needed to calculate scores. The bettor results determination module 220 could communicate with the data collection module 210 and the odds generation module 215 to determine how well a bettor's selected player lineup performed in relation to other bettors' selected player lineups.

The final module shown in FIG. 2 is a bettor payout evaluator module 225. This module could communicate with other modules to determine the bettor payout, if any, and then have that payout information reported to the bettor. For example, the bettor payout evaluator module 225 could communicate with the odds generator module 215, bettor results determination module 220, and data collection module 210 to determine the payout amount going to the bettor based on such things as the bettor's wager, the bettor's bet type, the bettor's one or more lineups, those lineups' paramutual-style odds, any ties, the house take, and others. Those skilled in the art can understand how a paramutual-style betting system affects the paramutual-style odds and payout for a particular lineup.

Those of skill in the art can imagine the various house "take" or "commission" rules or minimum payout rules that can be implemented for paramutual-style fantasy betting. In one exemplary embodiment, a commission could be taken from the aggregate bet amounts for a particular event or proposition without requiring a minimum payout to winning bettors. In another exemplary embodiment, the method and system could be setup to require a minimum payout to bettors that achieve certain results with their lineup selections. In yet another exemplary embodiment, the commission could be a flat rate taken from bettors before they are allowed to place their bets or taken from winnings before winnings are paid to bettors. Other methods for the collection of commissions or takes could be imagined by those of skill in the art.

In fantasy sports, outcomes are based on statistics from an event and may result in players or lineups that receive the same number of points. In one embodiment, all those bettors that received the highest point total for a particular proposition would all be considered to have won. It is possible for lineups consisting of different fantasy players to receive the same number of fantasy points. In some cases of paramutual-style fantasy betting, winning lineups consisting of different players may have had different paramutual-style odds. Therefore, payouts for even winning lineups on bets for those lineups to win may differ.

For example, in one exemplary embodiment involving a fantasy football proposition requiring the bettor to choose one quarterback, two quarterbacks (QB #1 and QB #2) may have each gained 20 fantasy points and no other quarterback gained as many points. QB #1 may have received $5 in wagers to win and QB #2 may have received $20 in wagers to win. As those of skill in the art understand, the paramutual-style odds for QB #1 result in a higher payout for a bettor who bet QB #1 to win than for a bettor who bet QB #2 to win based on the amount bet on each. Consequently, a bettor who wagered $1 on QB #1 would receive more money in winnings that a bettor who wagered $1 on QB #2 even though both quarterbacks tied in the number of fantasy points.

Furthermore, there could be a tie at any place in the standings where lineups consisting of different players gained the same number of fantasy points. In one exemplary embodiment, the payout, if any, for those lineups finishing in that place in the standings would be proportional to the paramutual-style odds for the different lineups. For example, a bettor may wager on fantasy football in which the proposition calls for the selection of three position players. A first bettor may select Peyton Manning as the quarterback along with a running back and a kicker. A second bettor may select Tom Brady as the quarterback with the same running back and the same kicker. Assume Peyton Manning and Tom Brady gained the same number of fantasy points for the event and also assume that the two lineups finished with the most fantasy points of all the lineups selected among all the bettors. Next assume that the paramutual-style odds for Peyton Manning to win the most fantasy points for quarterbacks were 2 to 1 and the paramutual-style odds for Tom Brady to win the most fantasy points for quarterbacks were 3 to 2. The lineup for the first bettor, who picked Peyton Manning, would have had longer paramutual-style odds than the lineup for the second bettor, who picked Tom Brady. In other words, the lineup for the first bettor would result in a larger payout than the lineup for the second bettor assuming that each bettor wagered the same amount, selected the same paramutual-style bet type, and selected their lineups gained enough points for their paramutual-style bet types to payout. Consequently, even if both bettors chose their lineups to win, both bettors wagered the same amount, and their selected lineups gained more points than any other lineup selected by any bettor; the first bettor would receive a larger payout than the second bettor.

Figure 3:
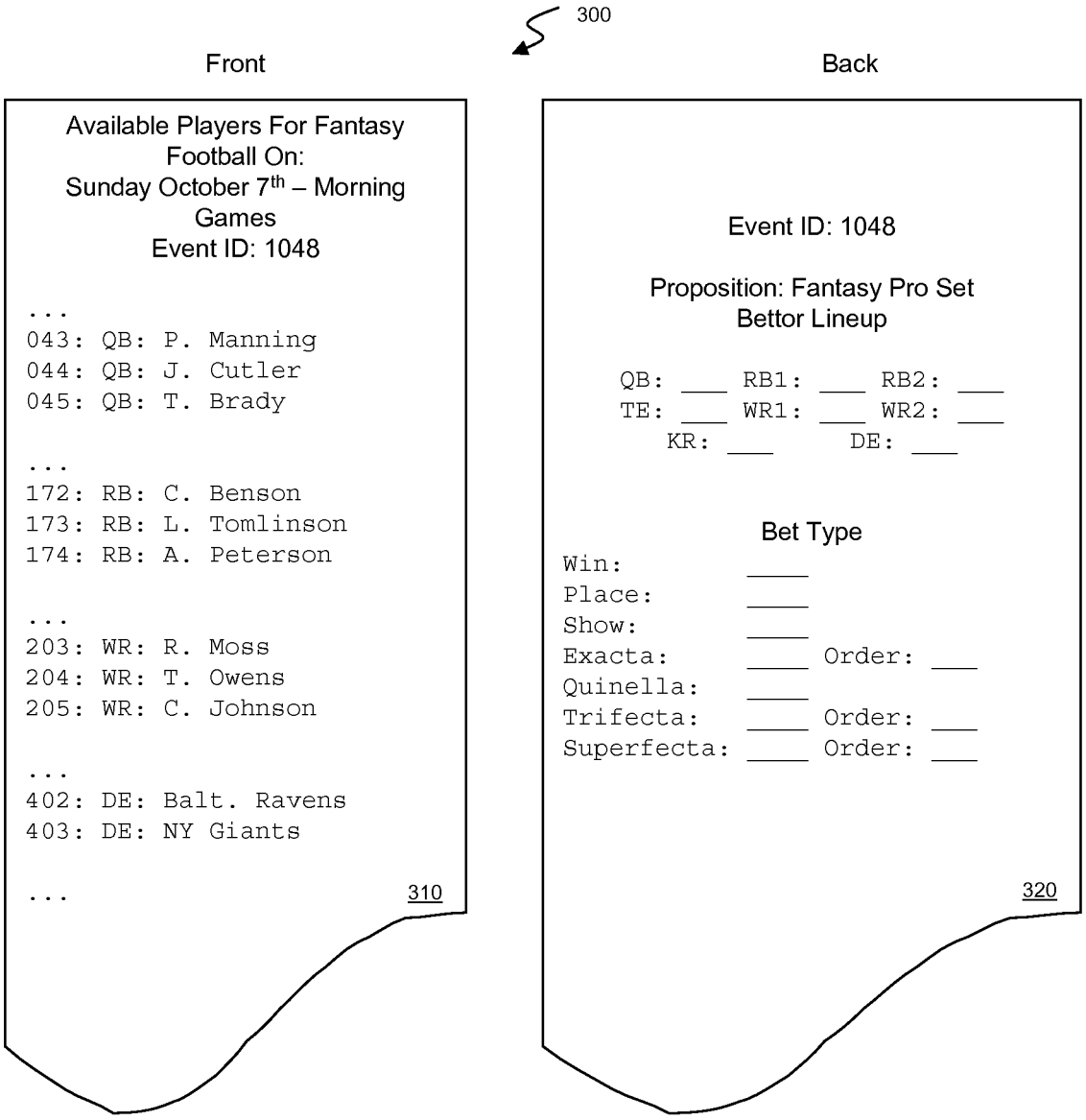
FIG. 3 illustrates a paper sports betting slips that could be used with embodiments of the present invention.

Although one embodiment disclosed herein uses interactive electronic devices in order to present information to and acquire information from a bettor, FIG. 3 represents an exemplary embodiment of paper sports betting slip 300 that could be used. The front of the paper sports betting slip 310 in FIG. 3 lists the available players for a specific event. The available players could be grouped in tiers or listed by traditional fantasy sports value to inform the bettor of which players are more likely to gain more fantasy points. In the exemplary embodiment of FIG. 3, the back of the paper betting slip 320 contains eight form fields where the bettor can fill in his or her selected players. Also on the back of the paper betting slip 320 are the bet types available to the bettor. The betting slip 300 would have additional form fields for bet types that call for the bettor to select more than one lineup. For example, the betting slip 300 as embodied in FIG. 3 would allow the bettor to place an exacta wager in which the bettor would select two different lineups and indicate which of the lineups would finish first and which of the lineups would finish second.

Also, those skilled in the art can understand how a betting slip 300 could accommodate different types of fantasy propositions which called for different lineups. For example, the betting slip 300 as embodied in FIG. 3 could also allow the bettor to select just quarterbacks rather than entire an entire fantasy lineup. Additionally, those skilled in the art can understand how the use of betting slips 300 could be combined with electronic devices. For example, the available players list could be displayed on an electronic device, such as a television display, while a bettor uses a paper betting slip 300 to indicate player selections. As those skilled in the art can understand, numerous variations could be made to a betting slip 300 without affecting the present invention.

After the bettor has filled out the betting slip 300 to indicate his or her selected lineups and bets, the information from the betting slip 300 would need to be collected (not shown). In one embodiment, the information from a betting slip 300 could be read and entered manually. In another embodiment, a betting slip 300 could be electronically scanned to collect the bettor's selected lineup. Those skilled in the art can understand various ways the information from a betting slip 300 could be collected consistent with the present invention.

Figure 4:
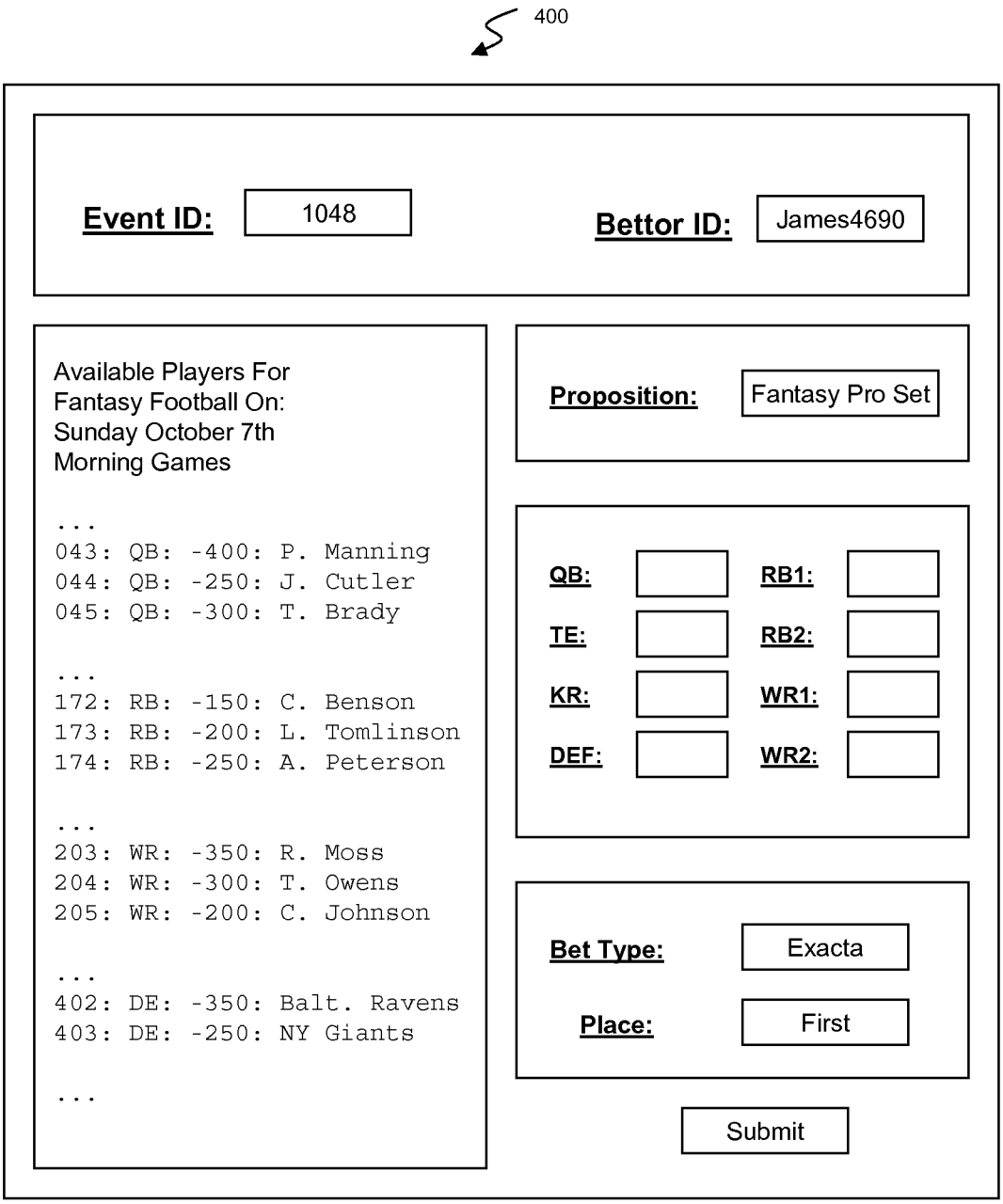
FIG. 4 illustrates a betting interface screen that could be used with embodiments of the present invention.

Referring now to FIG. 4 it represents an exemplary embodiment of a betting interface screen 400 for the devices from FIG. 1. FIG. 4 illustrates a screen with areas to display players lists and bettor information, to input selected events, propositions, bet types, and lineups. It would be obvious to those skilled in the art that this information can be further separated, combined, or reorganized within the scope of the present invention. The betting interface screen 400 may be a touch screen display that, for example, allows bettors to drag and drop selected players into their lineup. In another embodiment the screen may include data entry fields that allow users to use an attached keyboard or keypad to enter selected players by number and bet amounts. Those skilled in the art can understand many variations on the functionality of the betting interface screen consistent with the present invention.

Since there will be a limited amount of interest in an event, in some embodiments of the present invention it will be beneficial to limit the number of possible propositions. In the preferred embodiment, the number of possible propositions is limited to no more than 24 propositions. This can be done by presenting a bettor with a limited number of player types, and a limited number of players within each player type to select from. For example, by limiting the bettor to selecting one player from each of two different sets of four players the total number of different possible propositions would be limited to 16. Those skilled in the art will be aware of numerous modifications and changes consistent with the present invention.

In one embodiment of the present invention, the available fields and options in FIG. 4 could be limited to control the bettor's options and the number of propositions. For example, if for one embodiment only 16 possible propositions are desired, FIG. 4 could limit the available players screen to two player types (e.g., QB and RB) with four options for each player type. In this embodiment, the fields for TE, RB2, KR, WR1, WR2 and DE would be unavailable or not present. Those skilled in the art will be aware of many modifications consistent with the present invention.

Figure 5:
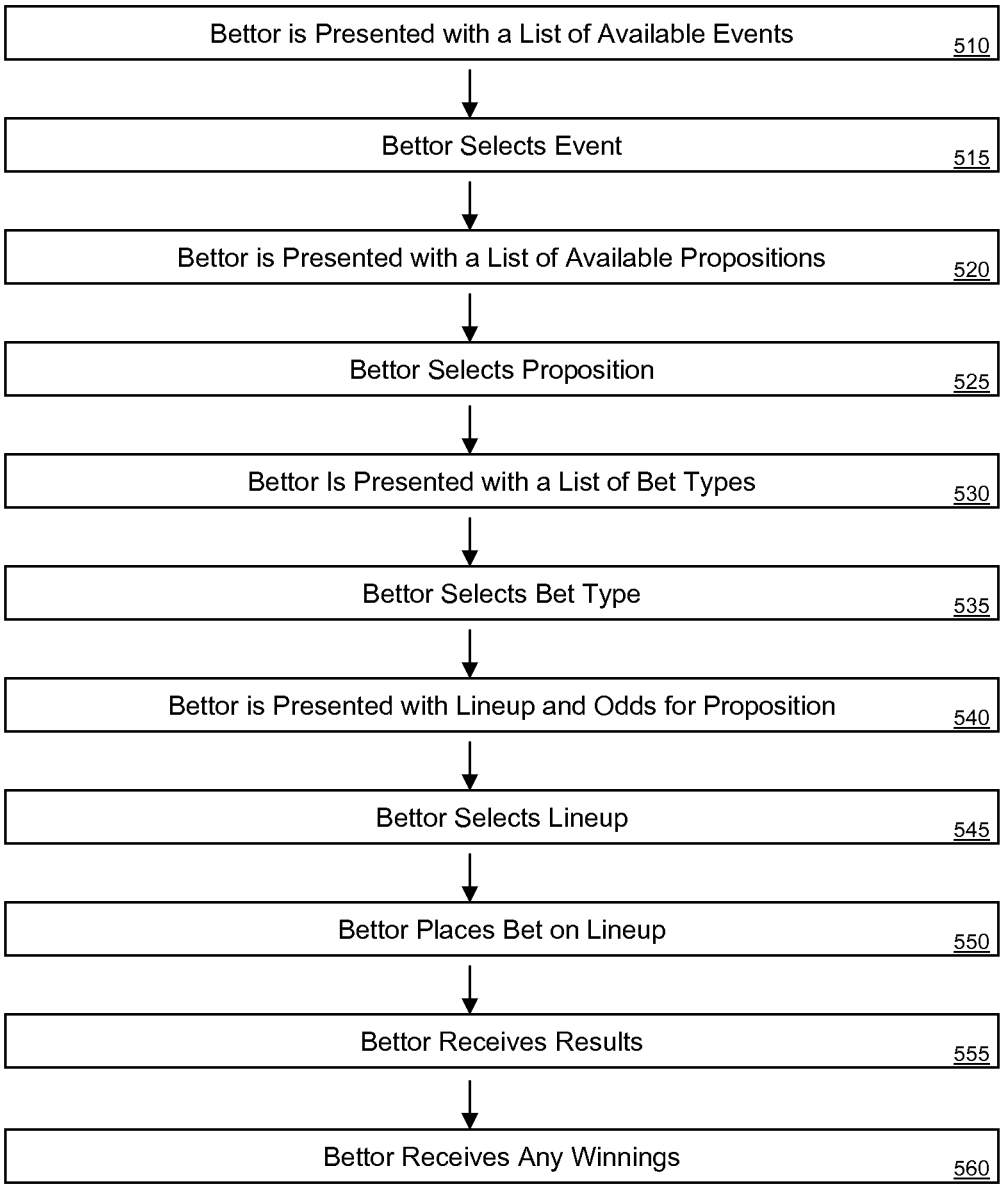
FIG. 5 illustrates one method by which a bettor can make a paramutual-style wager on fantasy sports.

In FIG. 5, a flow chart represents broadly one method by which a bettor wagers in paramutual-style fantasy betting. The use of the term "fantasy" is intended to be descriptive for those who are skilled in the art, and is not in any way meant to limit the present invention to fantasy sports. In the first step in FIG. 5, the bettor could be provided with a list of available events 510 such as "NHL Hockey 2007-08 Season", "NHL 2007-08 Playoffs", "NCAA I-A Football Games for Saturday September 4", "MLB Games for Saturday and Sunday September 4-5", "NFL Games for Sunday Morning", "NFL Week 6 Games", "Football Games (NCAA I-A and NFL) for Thursday through Monday September 2-6", or "Formula 1 Racing for the Week of September 1". This allows the bettor to select an event 515 that meets the bettor's time and curiosity constraints. It is to be understood that in other exemplary embodiments the bettor might not be provided with any events, but might be limited to one or more predetermined events.

After an event has been selected, the bettor could be presented with a list of propositions 520. Propositions may involve only one player type or multiple different player types. For example, in an exemplary embodiment, for fantasy football, a bettor may be presented with propositions such as Top 24 Quarterbacks (or any other position) in which the bettor wagers on only quarterbacks (or just one position), a selection of three predetermined positions (e.g., quarterback, running back, and kicker), or Fantasy Pro Set in which the bettor wagers on full team of positions as exemplified in the betting sheets in FIGS. 3 and 4. For fantasy auto racing, the bettor may be presented with propositions such as selecting one driver, selecting an entire team of drivers, or creating a custom team of drivers. Player types may differ depending on the fantasy sport involved. For example, in fantasy football, player types may include different player positions as well as offenses and defenses. In fantasy baseball, player types may include individual player positions or position types, such as pitching staffs. Those skilled in the art can understand the different types of propositions available based on the different fantasy sports event. After the bettor is presented with a list of propositions 520, the bettor is able to select a proposition for the event 525. It is to be understood that in other exemplary embodiments the bettor might not be presented with any propositions, but might be limited to one or more predetermined propositions. In that case, the bettor may simply be presented with and select players for those one or more propositions.

Next in an exemplary embodiment, after selecting a proposition 525, the bettor could then receive available bet types 530 for the event and proposition. For example, the bettor could be presented with bet types such as Win, Place, Show, Exacta, Quinella, and so on. What's more, other paramutual-style bet types, such as "Win, Place, or Show," as discussed below could be made available to increase the wagering and entertainment options of bettors. Those skilled in the art are familiar with the many types of paramutual-style bet types.

In one embodiment, the bettor could then select a paramutual-style bet type 535. For those paramutual-style bet types requiring the bettor to select more than one lineup, the later step of selecting a lineup 545 could be repeated. For example, if the bettor selects a paramutual-style bet type of exacta, the bettor would have to select two lineups. Furthermore, some paramutual-style bet types require the bettor to select a finishing place in the event standings for each lineup. For example, if the bettor selects a paramutual-style bet type of exacta, the bettor would have to select which lineup would place first in the event standings and which lineup would finish second in the event standings. Those skilled in the art would understand the variations of paramutual-style bet types and the additional bet type information, such as placement in the standings of each selected lineup, that a bettor must select. Also, those of skill in the art understand that some paramutual bet types require the bettor to select multiple events, propositions, lineups or some combination of the three. For example, a Daily Double would require the bettor to pick a winning lineup in two separate events in one wager. Those events comprising the Daily Double could be disparate events, such as "NHL Hockey Games for Saturday" and "NFL Games for Sunday," or similar events, such as "MLB Games for Saturday Afternoon" and "MLB Games for Saturday Evening."

In other embodiments, the bettor may be able to select a paramutual-style bet type before selecting events, propositions, lineups, or players. It is to be understood that the foregoing steps of FIG. 5 could be reorganized consistent with the present invention.

In an exemplary embodiment, a paramutual-style bet type of "Win, Place, or Show" could be offered. For example, assume one fantasy football proposition for an event, all NFL weekend games, involved selecting three player positions: one quarterback, one running back, and one kicker. The statistical results for those positions after the weekend games show that the highest scoring quarterback gained 24 fantasy points, the highest scoring running back gained 18 fantasy points, and the highest scoring kicker gained 3 fantasy points. Therefore, the highest possible score for any bettor for that proposition was 45 fantasy points. However, the highest score among the bettors for that proposition was 43 fantasy points. Next assume that five bettors selected the same or different lineups that each resulted in a score of 43 fantasy points; eight bettors selected the same or different lineups that each resulted in a score of 37 fantasy points; and twelve bettors selected the same or different lineups that each resulted in a score of 34 fantasy points.

For the "Win, Place, or Show" bet type, all the bettors that have 43 fantasy points would receive the Win payout. All the bettors that have 37 fantasy points would receive the Place payout. And all the bettors that have 34 fantasy points would receive the Show payout. Assuming that people are picking in the same fashion as standard fantasy sports, they want to select the best players in their minds for these games. People are not picking players to "place," they are picking players they think will achieve the highest point totals.

It is possible in paramutual-style fantasy betting to offer this type of payout—one that allows for Win, Place, and Show—with Win being determined by maximum attained point value by a player and not potential maximum point value. Place and Show would be the next relatively lower, player-attained points values. Those of skill in the art understand how payout amounts are influenced by the paramutual-style odds, the wager, the paramutual-style bet type, and the order in which the lineup or player finishes in the standings. Further, other embodiments including different paramutual-style bet types may alter the rules for the bet types. For example, in one embodiment a "Place" bet type may require the first- or second-most attained point values while a "Show" bet type may require the first-, second-, or third-most attained point values. In another embodiment, a "Place" bet type may only require one of top four-most attained point values while a "Show" bet type may only require one of the top eight-most attained point values. This may accommodate the sheer number of possible point values to maximize payouts to bettors and increase the entertainment value by including more bettors in winning. Those of skill in the art understand that paramutual-style bet types can be tailored based on the events, available player selections, or both.

After the bettor has selected a paramutual-style bet type 535, the bettor could be presented with the lineups and players available for that proposition along with their paramutual-style odds 540. In an exemplary embodiment, the lineups and players available could be limited to both the event and proposition selected. For example, as displayed in FIG. 4, if a bettor wanted to wager on fantasy NFL football and wanted to be done before Sunday night, he could select the event ID that corresponds to the Sunday morning football games. The bettor would then be provided with a list of available propositions for fantasy NFL football and then a list of players available for those games before Sunday night and only for the proposition selected. So if the Denver Broncos were playing Monday Night Football, none of the members of the Denver Bronco team nor the team itself, would be available players for selection.

In one embodiment of the present invention, "player" can refer to a member of a football team, the defense of a football team, or a football teams itself. Those skilled in the art can realize that player could have other meanings in various fantasy sports schemes that would also be consistent with the present invention. Furthermore, it is clear that one embodiment could be restricted to one type of event, one type of proposition, or both such that the bettor would be presented with just the lineup or presented with just propositions and lineups and so on.

Returning to FIG. 5, paramutual-style odds for the lineup could be generated and presented to the bettor 540. The exemplary embodiment as shown in FIG. 5 shows that the paramutual-style odds may be presented for lineups. In another exemplary embodiment, the paramutual-style odds may be presented for individual players and may be presented after the bettor selects the players for a lineup. Those of skill in the art can see the various ways in which paramutual-style odds are presented to the bettor before the bettor places a wager. It is to be understood, however, that other embodiments of the present invention may: withhold paramutual-style odds for a player or lineup until after the bettor places their wager; present payout amounts at the conclusion of the event without having presented paramutual-style odds to the bettor; or present paramutual-style odds at some other time. Those skilled in the art can understand that in a paramutual betting system, the paramutual-style odds for a particular player selection change over time depending on betting patterns for a present event. Furthermore, in the present invention, paramutual-style odds may also be based on other factors such as betting patterns in previous events, injuries, a player's or lineup's opponents, etc.

After the bettor has selected a paramutual-style bet type and lineup, the bettor could then select an amount to wager 550. It should be understood that a wager could be monetary, non-monetary, or some combination of both. In this way, the present invention could be used for traditional gambling or recreational use. Moreover, even in the context of monetary wagering, the wager could be some portion of a bettor's point allotment which could be redeemable for monetary value. In another embodiment, as part of selecting an amount to wager, the bettor may not only select an amount but also transfer money, points, or some combination of both. Those skilled in the art would be aware of many variations on bets and wagering consistent with the present invention. In other embodiments, a bettor could select an amount to wager before selecting a paramutual-style bet type or players. It is to be understood that the order in which steps of FIG. 5 are presented is but one embodiment and that other embodiments could rearrange the order of the steps without affecting the present invention. As well, other embodiments could omit steps or include additional steps. For example, as discussed earlier, in other embodiments, the bettor might not be presented with a list of events 510 and the bettor might not select an event 515. For another example, another embodiment may require the bettor to enter personal information.

The bettor could receive the results of his or her bet and wager 555. In one embodiment, the results could consist of simply the bettor's winnings. In another embodiment, the results could consist of the fantasy player points, the scores or standings of the event or events, the payout amounts, and a listing of the bettors and each bettors winnings. Different embodiments of the present invention may call for different combinations of data points included in the results. Those of skill in the art can understand the many data points which may be included in results the bettor receives. Furthermore, results may also include the bettor's payout.

The bettor could also receive any winnings 560. Like wagers, winnings may be monetary, non-monetary, or some combination of both. In one embodiment, the bettor may receive a payout in cash or credit. Further, bettors may receive winnings through different channels. For example, the bettor may receive winnings from a person responsible for paying out winnings or the bettor may receive winnings from an automated payout machine. In another embodiment, wagers and payouts may be accomplished through credit card-like memory storage in which points or credit are subtracted and added when the bettor places wagers and receives payout results. Those of skill in the art can understand the different methods and channels through which bettors receive payouts.

FIG. 5 presents only one possibility of what would happen after the bettor is presented his paramutual-style odds 540. Those skilled in the art would realize that after a bettor is presented with his paramutual-style odds, the bettor could further be given the ability to go back and change the selected lineup. In this way, the bettor would be given a chance to make changes until the bettor received paramutual-style odds that he wanted to bet on. Moreover, in another embodiment, the paramutual-style odds calculation may be dynamic, allowing the bettor to monitor the paramutual-style odds as each player is selected. Other modifications consistent with the present invention would be obvious to those skilled in the art.

Figure 6:
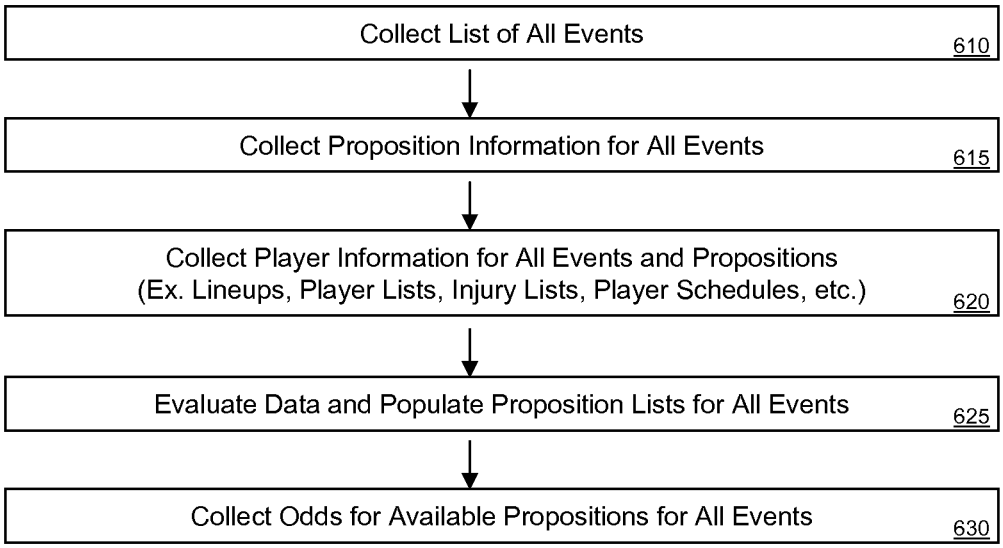
FIG. 6 illustrates one method for collecting event, proposition, and player information for paramutual-style fantasy betting.

Now referring to FIG. 6, it is a flowchart that illustrates one method for collecting event and player information for fantasy sports wagering. In the first step of FIG. 6, a list of all available events could be collected 610. This can be done in numerous fashions. In the exemplary embodiment, the data collection module 210 from FIG. 2 could collect this information. This information could be collected from manual entry or automatically via the internet through a statistics provider or some other external source. After the event list has been collected 615, the data collection module 210 could then collect propositions 615. Then the data collection module 210 could collect player information for all the events, propositions, or both 620. For example, information on lineups for a given game, schedules, injury lists would be needed in order to determine what players are actually available for a given event.

In another exemplary embodiment, collecting a list of events 610 may not be required. Furthermore, collecting a list of events may be done after collecting propositions 615 and collecting player information 620. It is to be understood that other embodiments may rearrange the order of, omit some, and include additional steps in FIG. 6 without affecting the present invention. Those of skill in the art can understand various combinations and permutations of steps that could be used for paramutual-style fantasy betting applications.

After the player information has been collected 620, an available players list for all events, propositions, or both can be populated 625. The data collection module 210 could be used to evaluate the data and populate an available players list for all events. In the exemplary embodiment, for fantasy football this would include checking which teams (defensive teams could be included as players) are playing, what players are hurt, etc. In other fantasy sports, there could be other considerations. For example, in baseball, the pitching rotation would be relevant to determine pitcher availability for a given event.

After the available players list has been populated the next step could be to collect paramutual-style odds for available players for all events, propositions, or both 630. Once again, the data collection module 210 could be used to collect the paramutual-style odds. The odds generator module 215 could be used to generate paramutual-style odds for available players from the wagers from already-collected bets stored in the data repository 125. Alternatively, the paramutual-style odds may be entered manually or collected automatically from an paramutual-style odds provider. Again, it is to be understood that in other embodiments the order of the steps in FIG. 6 could be rearranged, steps could be omitted, or additional steps could be included.

Figure 7:
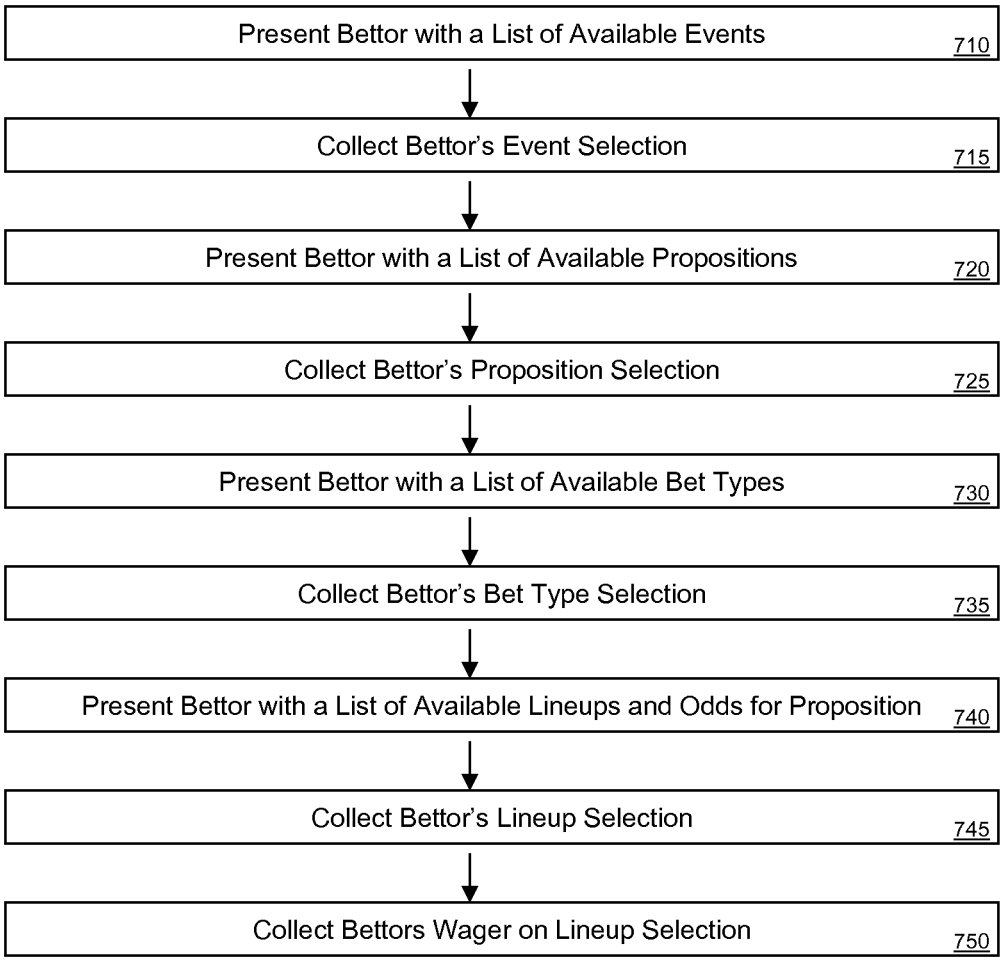
FIG. 7 illustrates one method for collecting a bettor's bet and wager information for paramutual-style fantasy betting.

FIG. 7 illustrates one method for collecting a bettor's bet and wager information for paramutual-style fantasy betting. First, FIG. 7 shows presenting a bettor with a list of available events 710. Here, the bettor interface module 205 could access the data collection module 210 to transfer the stored event list for presentation to the bettor. For example, the list might include baseball games split up into events that cover individual days or multi-day periods; the list might have different events for college football and pro football; or the list might include a weekend or a weekday basketball event. The bettor interface module 205 might present this information by printing the information out or by electronically displaying the information (not shown).

Then, in FIG. 7, the bettor's event selection could be collected 715. In one embodiment the bettor interface module 205 might communicate directly with the bettor's computing device to retrieve the event selection; or the information may be input by another person or machine using a written selection made by the bettor. After the bettor's event selection is collected 715, a list of propositions could be presented to the bettor 720. After the bettor's proposition is collected 725, available paramutual-style bet types could be presented to the bettor 730 and those bet types could be collected 735. Then, available players and paramutual-style odds could be presented to the bettor 740 for the selected event and proposition. Again, in the exemplary embodiment the bettor interface module 205 could be used to present the event, proposition, paramutual-style bet type, player, and paramutual-style odds information. It can be realized by those skilled in the art that other modules or other schemes could be used consistent with the present invention. For example, the data collection module 210 may be fully capable of returning information without using the bettor interface module 205.

While in the exemplary embodiment of FIG. 7, the first three steps are distinct, it would be realized by those skilled in the art that a list of available events may be presented simultaneously with a list of propositions, available players, and paramutual-style odds for those players. For example, FIG. 4 shows an exemplary embodiment of the invention as described in FIG. 7 where the players list displays only available players for the selected event and proposition. However, it could be imagined that numerous betting slips, such as the one in FIG. 3, are provided to the bettor for all the available events and propositions with the available players listed on the betting slip.

Back to FIG. 7, after presenting the lineup and paramutual-style odds information to the bettor 740, the bettor's lineup could be collected 745. The bettor interface module 205 could take the bettor's lineup and communicate it both to the data collection module 210 for storage and to the odds generator module 215. Storage is not necessary for the present invention but may serve additional purposes beyond the present invention, including tracking bettor personal information or betting habits of bettors. The odds generator module 215 could then generate paramutual-style odds for the bettor's lineup. After paramutual-style odds are generated, they could be presented to the bettor 740. The bettor interface module 205 could present the bettor with paramutual-style odds for the selected lineup.

Various types or forms of paramutual-style odds could be presented to the bettor. In the exemplary embodiment as shown in FIG. 4, paramutual-style odds are represented by positive or negative values. Positive values reflect the net return for a bet of 100 and negative values reflect the (negative of the) amount that needs to be bet in order to net a return of 100. In the exemplary embodiment as shown in FIG. 4, the use of negative values has been selected. In another embodiment, paramutual-style odds could be presented as ratios reflecting the player's or lineup's paramutual-style odds of winning as determined at least in part by the betting activity on the player or lineup. Those skilled in the art can realize the various forms in which paramutual-style odds may be presented.

Returning to the final step in FIG. 7, the bettor's bet and wager on the lineup could be collected 750. The bettor interface module 205 could once again collect this information from the bettor and communicate it to the data collection module 210 for storage. It will be realized by those skilled in the art that the bettor may additionally receive some sort of bet receipt or verification. As discussed previously, there are numerous types of bets and wagers that could be collected from the bettor. Also, as discussed previously for FIG. 5, other exemplary embodiments of the present invention may rearrange the order of steps, omit certain steps, or include additional steps without affecting the present invention.

Figure 8:
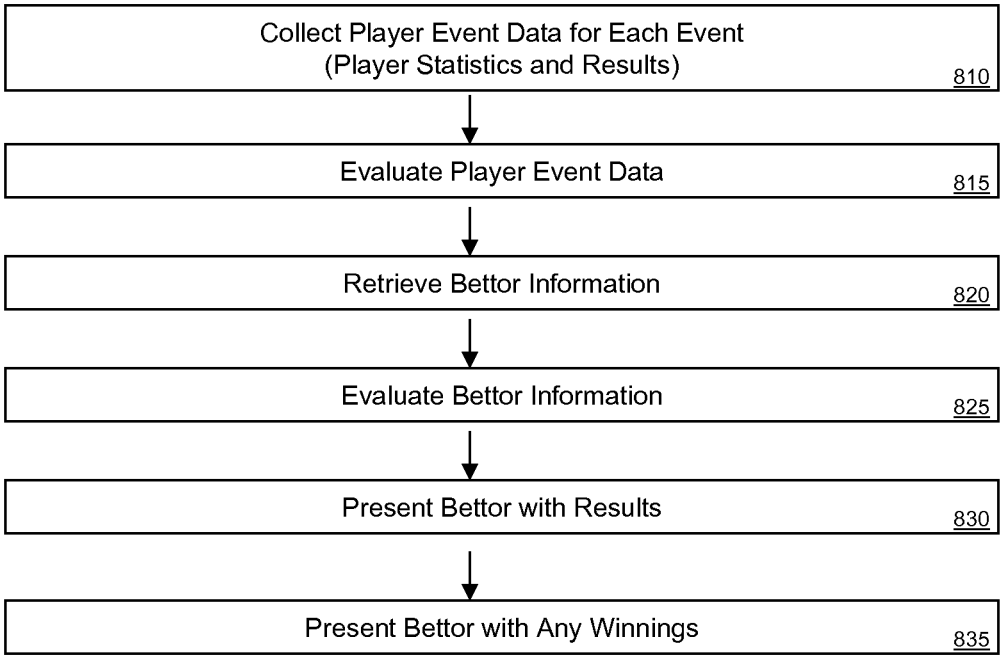
FIG. 8 illustrates one method for returning bet and wager outcomes to bettors.

Now referring to FIG. 8, there is a flowchart representing one method for returning bet and wager outcomes to bettors. In the first step of FIG. 8, player event data for each event could be collected 810. The data collection module 210 could be used to collect this information. The information could be collected on a real-time basis or it could be collected after an event is finished. If the player event data is collected on a real-time basis, bettors could be updated with the progress of their selected lineup (not shown) and even alerted about bet outcomes before the event is completed.

Player event data could include player statistics and results. In the exemplary embodiment for fantasy football, this would including collecting, at least, all relevant statistics such as touchdowns, touchdown passes, turnovers, field goals, etc. In another embodiment such as fantasy baseball, statistics such as homeruns, strikeouts, saves, RBIs, etc. would be collected. Those skilled in the art will be aware of the player event data that would need to be collected for various fantasy sports.

After the player event data for each event has been collected, the next step could be to evaluate the player event data 815. This step, which is described in more detail in relation to FIG. 9, can be accomplished using the bettor results determination module 220. The general purpose of this step is to convert event statistics into fantasy sports points consistent with the types of bets being received. It should be realized by those skilled in the art, that as the popularity of fantasy sports increases, player event data for each event may simply be collected with a fantasy sports point total already included. In this sense, the step of evaluating player event data may be done by another system or method and simply collected for use in this method and system. It is to be understood that the present invention is not limited to using traditional fantasy-sports-based point systems. Those of skill in the art can imagine scoring systems that apply various types of scoring based on the events and propositions made available.

Referring back to FIG. 8, after the player event data is evaluated, bettor information could be retrieved 820. In the exemplary embodiment the bettor information can be stored in the data collection module 210 and could be retrieved by the bettor results determination module 220. After the bettor results determination module 220 retrieved the bettor information it could evaluate the bettor information 825, which is discussed more thoroughly in the discussion relating to FIG. 10.

The next step in FIG. 8 could be to present the bettor with a result 830. For the exemplary embodiment, this step could involve using the bettor interface module 205 to communicate the bettor outcome from the bettor payout evaluator module 225 to the bettor. This could include simply informing the bettor that she lost or it could include informing the bettor of a list of all payouts to all bettors along with the fantasy points and game scores or competition standings. Those of skill in the art can understand the many data combinations to present to the bettor.

The final step shown in FIG. 8 could be to present the bettor with any winnings 835. Again, as mentioned above, many embodiments can be imagined involving monetary or non-monetary payout methods and the different channels through which to present winnings to the bettor. It is to be understood that other exemplary embodiments may rearrange the order of, omit, or included additional steps of FIG. 8. For example, retrieval of bettor information 820 could be done before or simultaneous with collecting player event data 810. Further, the steps of FIG. 8 could also be combined or further divided into additional steps.

Figure 9:
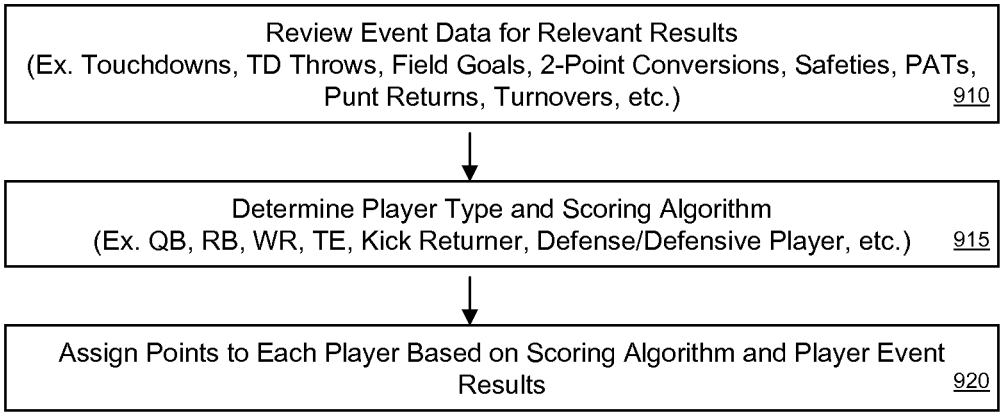
FIG. 9 illustrates one method for evaluating player event data.

Referring now to FIG. 9, there is a flowchart that illustrates one method for evaluating player event data. In the exemplary embodiment the event data could be evaluated by the bettor results determination module 220. In the first step of FIG. 9, the player event data could be reviewed for relevant results 910. In the exemplary embodiment the relevant results are the statistics that score in fantasy football: touchdowns, touchdown throws, field goals, etc. After that, the player type and the applicable scoring algorithm could be determined 915. Determining player type could include both determining the proper fantasy sport and the specific type of player within the fantasy sport. For example, it may not be enough to say that Champ Bailey is a football player, but you might also have to identify that Champ Bailey is a Denver Broncos defensive player. Since Champ Bailey might not be selected individually his player type might important to fit his statistics into the applicable scoring algorithm.

After the player type and scoring algorithm are identified, the system could assign points to each player based on the scoring algorithm and player event results 920. For example, in the exemplary embodiment if Champ Bailey has an interception for a touchdown, the scoring algorithm would appoint eight points to defensive player Denver Broncos, two for the interception and six for the touchdown. In the exemplary embodiment, this process could take place in the bettor results determination module 220 which could transfer all player point totals to the data collection module 210 for storage. Also, other scoring systems can be used that allot different point amounts for player accomplishments. It is to be understood that the steps of FIG. 9 could be split into more discrete steps or combined. Further, the order of the steps could be rearranged such that determining the player types and algorithms 915 could be done first. Also, other embodiments may retrieve the results of all of the steps of FIG. 9 after they are accomplished externally.

Figure 10:
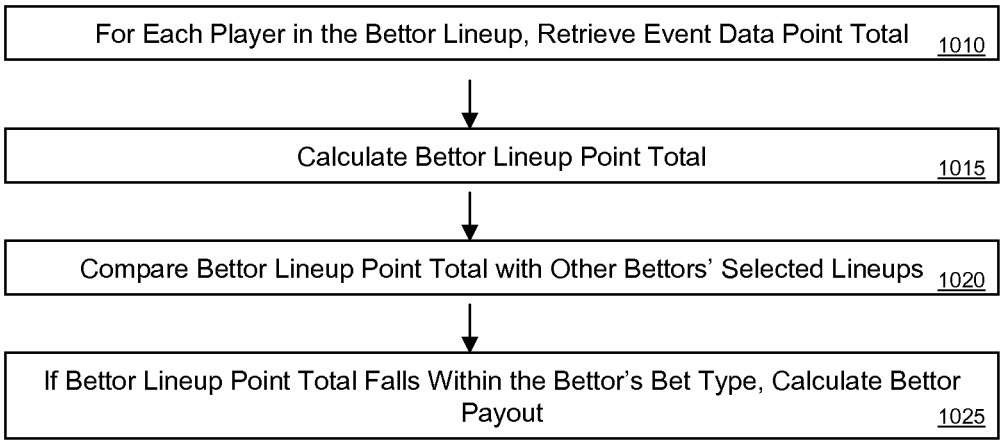
FIG. 10 illustrates one method of evaluating bettor information and returning bettor outcomes.

Referring now to FIG. 10, there is an illustration of one method of evaluating bettor information and returning bettor outcomes. In the first step of FIG. 10, for each player in the bettor's lineup, the player event data point total could be retrieved 1010. In the exemplary embodiment, this could involve the bettor payout evaluator module 225 communicating with the data collection module 210 both to collect the bettor's lineup and to collect player event point totals. Alternatively, the bettor results determination module 220 could also be where player event point totals are stored for collection. After that information is retrieved the bettor lineup point total could be calculated 1015. In the exemplary embodiment for fantasy football this simply involves totaling the points for each player in the bettor's lineup. Those skilled in the art will be aware of how lineup totals are determined in other fantasy sports.

After the bettor's lineup point total is calculated, the lineup point total could be compared with the point totals of the other lineups on which a bet was placed to determine the placement in the standings of the bettor's lineup within the proposition 1020. After a bettor's lineup has received a placement relative to other bettors' lineups for the proposition, the final step in FIG. 10 could calculate bettor payout, if any 1025. Again, it is to be understood that the steps of FIG. 10 could be further separated or combined. For example, in one embodiment, a bettor lineup point total could be determined as each player point total is retrieve, thus combining the first two steps. Furthermore, other embodiments may continuously retrieve player points 1015 and compare bettor lineup points 1020 during the event. Those of skill in the art can understand the various combinations in which bettor outcomes are calculated.

In conclusion, the present invention provides, among other things, a system and method for paramutual-style fantasy betting. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A system for displaying and receiving information relating to fantasy sports betting via electronic display devices to facilitate customized electronic paramutual-style fantasy sports betting for a fantasy sports lineup, the system comprising one or more processors positioned remotely from, and communicably coupled via the Internet to, network devices associated with the electronic display devices, wherein the one or more processors include an input/output controller of a betting engine for the customized electronic paramutual-style fantasy sports betting, and are configured to execute program instructions including a plurality of modules to cause the one or more processors to:

receive, using a data collection module and from an external sports statistics provider communicably coupled to the one or more processors, player event data for the fantasy sports lineup including: a first plurality of players of a first player type, and a second plurality of players of a second player type;

collect, using the data collection module, one or more propositions available for: a fantasy sports event, the first plurality of players, and the second plurality of players, from the external sports provider;

cause, using a bettor interface module, a betting interface screen to be displayed to a first bettor of the at least two bettors on an electronic display device associated with a first network device of at least two network devices;

initiate, using the bettor interface module, and via the betting interface screen, electronic communications between the first network device and the input/output controller;

cause, using the bettor interface module, and via the betting interface screen: the first and second pluralities of players to be displayed with respective player types to the first bettor in a first area of the betting interface screen, and the one or more propositions for the fantasy sports events to be displayed to the first bettor in a second area of the betting interface screen different from the first area;

receive, using the data collection module, and via the betting interface screen, a selection by the first bettor of: the fantasy sports lineup of multiple players, and a proposition, for the sports event via the first area, and the second area, respectively;

receive, using the data collection module, and via the betting interface screen: a wager amount, and a paramutual bet for the proposition, from the first bettor;

automatically collect, using the data collection module in real time from the external sports statistics provider, and in response to the paramutual bet being received: player event data for each event identified in the proposition, and statistical player information for the multiple players of the fantasy sport lineup selected by the first bettor;

calculate, using an odds generator module, and in response to the proposition, wager amount, and paramutual bet being received, paramutual-style odds for the proposition, wherein when executed by the one or more processors to calculate the paramutual-style odds, the program instructions further cause the one or more processors to:

continuously and dynamically calculate the paramutual-style odds based at least in part on: betting patterns of the first bettor, betting patterns of at least a second bettor of the at least two bettors operating at least a second network device of the at least two network devices to electronically communicate with the betting engine, a combination of odds for the multiple players in the fantasy sports lineup, and the statistical player information;

cause, using the bettor interface module, and via the betting interface screen, the paramutual-style odds to be displayed to the first bettor in a third area of the betting interface screen different from the first and second areas, wherein when executed by the one or more processes to cause the paramutual-style odds to be displayed, the program instructions further cause the one or more processors to:

as each player of the multiple players is selected or deselected for the fantasy sports lineup by the first bettor via the first area, dynamically update, and continuously present via the third area, the paramutual-style odds to the first bettor to facilitate monitoring, by the first bettor, of changes to the paramutual odds before the close of betting;

evaluate, using a bettor results determination module, the player event data to compute, using a scoring algorithm being run by the one or more processors, fantasy points earned by the fantasy sports lineup selected by the first bettor;

determine, using a bettor payout evaluator module, a result for the first bettor based on: the paramutual bet, the fantasy points earned by the fantasy sports lineup, and the proposition;

cause, using the bettor interface module, and via the betting interface screen, the result to the displayed to the first bettor; and cause, by the bettor results determination module, winnings to be received by the first bettor that are consistent with the result for the first bettor.

2. The system of claim 1, wherein when executed by the one or more processors to calculate the paramutual-style odds, the program instructions further cause the one or more processors to calculate the paramutual-style odds further based on a weighting according to betting activity on certain players within the fantasy sports lineup selected by the first bettor.

3. The system of claim 1, further comprising a data repository.

4. The system of claim 1, wherein the winnings include monetary winnings, non-monetary winnings, or a combination of monetary and non-monetary winnings.

5. The system of claim 4, further comprising a memory storage communicably coupled to the one or more processors, wherein the winnings are added to the memory storage in which points or credits are subtracted and added when the first bettor places a wager and receives the result.

6. The system of claim 1, further comprising an automated payout machine to transfer the winnings to the first bettor.

7. The system of claim 1, wherein when executed by the one or more processors, the program instructions further cause the one or more processors to automatically collect, using the data collection module, the player event data for each event identified in the proposition in real-time.

8. The system of claim 7, wherein when executed by the one or more processors, the program instructions further cause the one or more processors to send, using the data collection module, an update to the first network device that generates an alert, via the betting interface screen, regarding progress of the fantasy sports lineup.

9. A method for displaying and receiving information relating to fantasy sports betting via electronic display devices to facilitate interactive electronic paramutual-style fantasy sports betting for a fantasy sports lineup using a server positioned remotely from, and in communication via the Internet with, network devices associated with the electronic display devices, the method comprising:

receiving, by a data collection module operated by the server communicably coupled with at least two network devices operated by at least two bettors: event data for a sports event, and player event data for the sports event, from an external sports statistics provider in communication with the server, wherein the event data for the sports event includes an event schedule, and wherein the player event data includes: a first plurality of players of a first player type, and a second plurality of players of a second player type, available for the sports event;

collecting, by the data collection module, one or more propositions available for: the sports event, and the first and second pluralities of players, from the external sports statistics provider;

causing, by a bettor interface module operated by the server, a betting interface screen to be displayed to a first bettor of the at least two bettors on an electronic display device associated with a first network device of the at least two network devices;

initiating, by the bettor interface module, and via the betting interface screen, electronic communications between the first network device and an input/output controller of a betting engine of the server for the interactive electronic paramutual-style fantasy sports betting;

causing, by the bettor interface module, and via the betting interface screen: the first and second pluralities of players to be displayed to the first bettor with respective player types in a first area of the betting interface screen, and the one or more the propositions for the sports event to be displayed to the first bettor in a second area of the betting interface screen different from the first area;

receiving, by the data collection module, and via the betting interface screen: the fantasy sports lineup of multiple players, and a proposition, for the sports event selected by the first bettor via the first area, and the second area, respectively;

causing, by the better interface module, and via the betting interface screen, one or more available bet types for the proposition to be displayed to the first bettor in a third area of the betting interface screen different from the first and second areas;

receiving, by the data collection module, and via the betting interface screen, a bet type selected by the first bettor via the third area;

receiving, by the data collection module, and via the betting interface screen: a wager amount, and a paramutual bet for the proposition, from the first bettor;

receiving, by the data collection module automatically and in real time from the external sports statistics provider, and in response to receiving the paramutual bet, statistical player information for the multiple players of the fantasy sport lineup selected by the first bettor;

calculating, by an odds generator module operated by the server, paramutual odds for the proposition, wherein calculating the paramutual odds comprises:

continuously and dynamically calculating the paramutual odds based at least in part on: betting patterns of the first bettor, betting patterns of at least a second bettor of the at least two bettors operating at least a second network device of the at least two network devices to electronically communicate with the betting engine, a combination of paramutual odds for the multiple players in the fantasy sports lineup, and the statistical player information;

causing, by the bettor interface module, and via the betting interface screen, the paramutual odds to be displayed to the first bettor in a fourth area of the betting interface screen different from the first, second, and third areas, wherein causing the paramutual odds to be displayed comprises:

as each player of the multiple players is selected or deselected for the fantasy sports lineup by the first bettor via the first area, dynamically updating, and continuously presenting via the fourth area, the paramutual odds to the first bettor to facilitate monitoring, by the first bettor, of changes to the paramutual odds before the close of betting;

evaluating, by a bettor results determination module operated by the server, the player event data to compute, using a scoring algorithm running at the server, fantasy points earned by the fantasy sports lineup selected by the first bettor;

determining, by a bettor payout evaluator module operated by the server, a result for the first bettor based on: the paramutual bet, the fantasy points earned by the fantasy sports lineup, and the proposition;

causing, by the bettor interface module, and via the betting interface screen, the result to be displayed to the first bettor; and causing, by the bettor results determination module, winnings to be received by the first bettor according to the result.

10. The method of claim 9, wherein receiving the wager amount from the first bettor comprises receiving a monetary wager amount from the first bettor, and wherein the combination of paramutual odds for players in the fantasy sports lineup includes weights assigned to each of the paramutual odds for the players.

11. The method of claim 9, further comprising receiving, by the data collection module, and via the betting interface screen, a selected event from the first bettor, wherein the selected event comprises the first and second pluralities of players.

12. The method of claim 9, wherein calculating paramutual odds for the proposition further comprises calculating final paramutual odds for the proposition after betting is closed for the paramutual bet.

13. The method of claim 12, further comprising determining a payout for the first bettor based on: the result, the wager amount, and the final paramutual odds.

14. The method of claim 9, wherein calculating the paramutual odds for the proposition further comprises calculating current paramutual odds for the proposition periodically while betting is open for the paramutual bet.

15. The method of claim 14, further comprising presenting the current paramutual odds to a plurality of potential bettors via respective electronic display devices associated with network devices operated by the plurality of potential bettors.

16. A method for displaying and receiving information relating to fantasy sports betting via electronic display devices to facilitate customized electronic paramutual-style fantasy sports betting for a fantasy sports lineup using a server positioned remotely from, and in communication via the Internet with, network devices associated with the electronic display devices, the method comprising:

causing, by a bettor interface module operated by the server communicably coupled with at least two network devices operated by at least two bettors, a betting interface screen to be displayed to a first bettor of the at least two bettors on an electronic display device associated with a first network device of the at least two network devices;

initiating, by the bettor interface module, and via the betting interface screen, electronic communications between the first network device and an input/output controller of the server for the customized electronic paramutual-style fantasy sports betting;

causing, by the bettor interface module, and via the betting interface screen: a first plurality of players, a second plurality of players, and one or more propositions, to be displayed to the first bettor in a first area, and a second area, of the betting interface screen, respectively, wherein the second area is different from the first area;

receiving, by a data collection module operated by the server, and via the betting interface screen, a selection by the first bettor via the first area of multiple players for the fantasy sports lineup from the first and second pluralities of players;

receiving, by the data collection module, and via the betting interface screen, a proposition selected from the one or more propositions by the first bettor via the second area;

causing, by the bettor interface module, and via the betting interface screen, at least a portion of the multiple players selected by the first bettor to be displayed to the first bettor in the second area;

receiving, by the data collection module, and via the betting interface screen, a wager amount from the first bettor;

receiving, by the data collection module automatically and in real time from an external sports statistics provider communicably coupled with the server, and in response to receiving the wager amount, statistical player information for the multiple players in the fantasy sport lineup;

calculating, by an odds generator module operated by the server, paramutual odds for the proposition, wherein calculating the paramutual odds comprises:

continuously and dynamically calculating the paramutual odds based at least in part on: betting patterns of the first bettor, betting patterns of at least a second bettor of the at least two bettors operating at least a second network device of the at least two network devices to electronically communicate with the server, a combination of paramutual odds for the multiple players in the fantasy sports lineup, and the statistical player information;

causing, by the bettor interface module, and via the betting interface screen, the paramutual odds to be displayed to the first bettor in a third area of the betting interface screen different from the first and second areas, wherein causing the paramutual odds to be displayed comprises:

as each player of the multiple players is selected or deselected for the fantasy sports lineup by the first bettor via the first area, dynamically updating, and continuously presenting via the third area, the paramutual odds to the first bettor to facilitate monitoring, by the first bettor, of changes to the paramutual odds before the close of betting;

computing, by a bettor results determination module operated by the server, fantasy points earned by the fantasy sports lineup selected by the first bettor by evaluating the player event data;

determining, by a bettor payout evaluator module operated by the server, a result for the first bettor based on: the wager amount, the fantasy points earned by the fantasy sports lineup, and the proposition;

causing, by the bettor interface module, and via the betting interface screen, the result to be displayed to the first bettor; and causing, by the bettor results determination module, winnings to be received by the first bettor according to the result.

17. The method of claim 16, further comprising receiving, by the data collection module, and via the betting interface screen, a change to the fantasy sports lineup from the first bettor.

18. The method of claim 16, wherein the multiple players include at least one fantasy football player.

19. The method of claim 16, wherein the proposition comprises a plurality of players of different player types.

20. The method of claim 16, further comprising receiving, by the data collection module, and via the betting interface screen, a selected event from the first bettor, wherein the selected event comprises the proposition, and wherein computing the fantasy points by the lineup comprises computing the fantasy points earned by the lineup based on the selected event.

21. The method of claim 16, wherein calculating paramutual odds for the proposition further comprises calculating final paramutual odds for the proposition after betting is closed for the paramutual bet.

22. The method of claim 21, further comprising determining a payout for the first bettor based on: the result, the wager amount, and the final paramutual odds.

23. The method of claim 22, wherein determining the payout for the first bettor comprises determining the payout for the first bettor further based on a commission amount to a betting house.

24. The method of claim 16, further comprising receiving, by the data collection module, and via the betting interface screen, a second proposition from the first bettor, wherein the second proposition comprises an at least one second player.

25. The method of claim 16, wherein the combination of the paramutual odds for players in the lineup include a weighted average.

26. A non-transitory computer-usable medium having program instructions stored thereon for displaying and receiving information relating to fantasy sports betting via electronic display devices to facilitate interactive electronic fantasy sports betting for a fantasy sports lineup, wherein when executed by one or more processors, the instructions cause a machine to:

cause a betting interface screen to be displayed to a first bettor on an electronic display device associated with a first network device in communication with the one or more processors running the program instructions and positioned remotely from, and in communication via the Internet with, the first network device;

initiate, via the betting interface screen, electronic communications between the first network device and an input/output controller of the one or more processors for the interactive electronic fantasy sports betting;

calculate pool betting odds for entry into a pool betting event for the interactive electronic fantasy sports betting, wherein when executed by the one or more processors to calculate the pool betting odds, the program instructions further cause the machine to:

calculate the pool betting odds based, at least in part, on: bettor activity of the first bettor, and bettor activity of at least two other bettors operating additional network devices to electronically communicate with the input/output controller, in the pool betting event;

cause, via the betting interface screen: a listing of one or more sports players, and one or more propositions for the pool betting event, to be displayed to the first bettor in a first area, and a second area, of the betting interface screen, respectively, wherein the second area is different from the first area;

receive, via the betting interface screen, entry data for the pool betting event from the first bettor, wherein when executed by the one or more processors to receive the entry data, the program instructions further cause the machine to receive: a selection of at least one sports player from the listing in the first area, a selection of a proposition from the one or more propositions in the second area, and a wager amount, from the first bettor for the pool betting event;

receive, via respective betting interface screens of electronic display devices associated with the additional network devices, a plurality of other entries in the pool betting event by the at least two other bettors;

retrieve, automatically and in real time from an external sports statistics provider communicably coupled to the one or more processors, player result data for the selection of at least one sports player made by the first bettor via the first area, wherein the player result data includes an amount of fantasy points earned by the at least one sports player based on an occurrence of a sporting event involving the at least one sports player;

cause via the betting interface screen, the pool betting odds to be displayed to the first bettor in a third area of the betting interface screen different from the first and second areas, wherein when executed by the one or more processors to calculate the pool betting odds, the program instructions further cause the machine to:

calculate the pool betting odds for the entry further based on the entry data; and as each sports player of the at least one sports player is selected or deselected for the pool betting event by at least one of: the first bettor via the first area, and one or more of the at least two other bettors via the respective betting interface screens, dynamically update, and continuously present via the third area, the pool betting odds to the first bettor to facilitate monitoring, by the first bettor, of changes to the pool betting odds before the close of betting;

determine a pool betting result for the first bettor including a payout based on: the pool betting odds, the wager amount, the player result data, and results of the plurality of other entries by the at least two other bettors;

cause, via the betting interface screen, the pool betting result to be displayed to the first bettor; and cause the payout to be received by the first bettor according to the pool betting result.

27. The non-transitory computer-usable medium of claim 26, wherein when executed by the one or more processors, the program instructions further cause the machine to present the pool betting result through a user interface module operated by one or more servers.

28. The non-transitory computer-usable medium of claim 26, wherein when executed by the one or more processors, the program instructions further cause the machine to:

present the pool betting result through a user interface module operated by one or more servers;

recalculate the pool betting odds for the pool betting event after the entry data is received from the first bettor; and update, through the user interface module, the pool betting odds based on the recalculated pool betting odds.

29. The non-transitory computer-usable medium of claim 26, wherein the pool betting event is a paramutual betting event, and wherein the pool betting odds are paramutual betting odds.

30. The non-transitory computer-usable medium of claim 26, wherein the pool betting event is a daily fantasy sports contest that limits the first bettor to a selection of one sports player that plays a specific position in a specific sport, wherein the proposition includes a selection of the at least sports player from a plurality of sports players that play the specific position in the specific sport, and wherein the plurality of other entries select one sports player from the plurality of sports players that play the specific position in the specific sport.

* * * * *